US009890630B2

(12) United States Patent
Ventre

(10) Patent No.: US 9,890,630 B2
(45) Date of Patent: Feb. 13, 2018

(54) METHOD FOR MEASURING PRESSURE IN AN UNDERGROUND FORMATION

(75) Inventor: Pierre Ventre, Pau (FR)

(73) Assignee: TOTAL S.A., Courtbevoi (FR)

( * ) Notice: Subject to any disclaimer, the term of this patent is extended or adjusted under 35 U.S.C. 154(b) by 949 days.

(21) Appl. No.: 13/990,819

(22) PCT Filed: Nov. 18, 2011

(86) PCT No.: PCT/IB2011/055185

§ 371 (c)(1),
(2), (4) Date: Aug. 19, 2013

(87) PCT Pub. No.: WO2012/073145

PCT Pub. Date: Jun. 7, 2012

(65) Prior Publication Data

US 2013/0327137 A1 Dec. 12, 2013

(30) Foreign Application Priority Data

Dec. 3, 2010 (FR) ..... 10 60061

(51) Int. Cl.
*E21B 47/06* (2012.01)
*E21B 49/00* (2006.01)
(Continued)

(52) U.S. Cl.
CPC ..... *E21B 47/06* (2013.01); *E21B 49/008* (2013.01); *E21B 49/087* (2013.01); *E21B 49/10* (2013.01)

(58) Field of Classification Search
CPC ..... E21B 49/10; E21B 47/06; E21B 49/008; E21B 49/087
(Continued)

(56) References Cited

U.S. PATENT DOCUMENTS 3,352,361 A * 11/1967 Urbanosky ..... E21B 49/10 166/100
3,385,364 A * 5/1968 Whitten ..... E21B 49/10 166/100
(Continued)

FOREIGN PATENT DOCUMENTS

CN 1495336 5/2004
CN 101092874 12/2006
(Continued)

OTHER PUBLICATIONS

International Search Report; International Application No. PCT/IB2011/055185; International Filing Date: Nov. 18, 2011; 4 pages.
(Continued)

*Primary Examiner* — John Fitzgerald
(74) *Attorney, Agent, or Firm* — Pearne & Gordon LLP

(57) ABSTRACT

The invention relates to a method for measuring pressure in an underground formation containing a fluid, comprising the following consecutive steps:

establishing fluid communication between a test chamber arranged in a drilling well and the underground formation, via a flowline;

moving a piston in the test chamber so as to suction fluid into the test chamber;

ensuring fluid isolation of the test chamber relative to the flowline;

measuring the pressure in the flowline; and repeating the preceding steps.

The invention also relates to a device for measuring pressure in an underground formation containing a fluid adapted for the implementation of said method.

20 Claims, 1 Drawing Sheet

(51) Int. Cl.
*E21B 49/08* (2006.01)
*E21B 49/10* (2006.01)

(58) Field of Classification Search
USPC ..... 73/152.24
See application file for complete search history.

(56) References Cited

U.S. PATENT DOCUMENTS 3,611,799 A * 10/1971 Davis ..... E21B 49/10 175/50
3,780,575 A * 12/1973 Urbanosky ..... E21B 49/10 166/100
3,858,445 A * 1/1975 Urbanosky ..... E21B 49/10 73/152.24
3,859,851 A 1/1975 Urbanosky
4,513,612 A * 4/1985 Shalek ..... E21B 49/10 73/152.24
5,138,877 A * 8/1992 Desbrandes ..... E21B 47/02 166/264
5,269,180 A 12/1993 Dave et al.
5,473,939 A * 12/1995 Leder ..... E21B 23/06 166/264
6,745,835 B2 * 6/2004 Fields ..... E21B 49/10 166/100
7,036,579 B2 * 5/2006 Follini ..... E21B 47/10 166/100
7,090,012 B2 * 8/2006 Hill ..... E21B 49/10 166/100
7,140,436 B2 * 11/2006 Grant ..... E21B 49/10 166/100
7,243,536 B2 * 7/2007 Bolze ..... E21B 49/081 166/264
7,263,880 B2 9/2007 Pop et al.
7,373,812 B2 * 5/2008 Ma ..... E21B 49/10 73/152.23
8,813,554 B2 * 8/2014 Fujisawa ..... E21B 49/081 73/152.27
2004/0216874 A1 11/2004 Grant et al.
2007/0175273 A1 * 8/2007 Follini ..... E21B 47/10 73/152.27
2007/0209793 A1 9/2007 Nold, III et al.
2007/0214877 A1 * 9/2007 Shammai ..... E21B 49/10 73/152.24
2009/0101339 A1 * 4/2009 Zazovsky ..... E21B 49/10 166/250.01
2009/0255671 A1 10/2009 Georgi et al.
2012/0304757 A1 * 12/2012 Fujisawa ..... E21B 49/081 73/152.27

FOREIGN PATENT DOCUMENTS

EP 1396607 10/2004
RU 2316650 2/2008
RU 2391503 6/2010
SU 1344256 10/1987

OTHER PUBLICATIONS

Written Opinion; International Application No. PCT/IB2011/055185; International Filing Date: Nov. 18, 2011; 6 pages.
English translation; Chinese Patent Application No. CN1495336; published May 12, 2004; 24 pages.
English translation; Russian Application No. RU2316650C2; published Feb. 10, 2008; 11 pages.
English translation; Russian Application No. RU2391503C2; published Jun. 10, 2010; 27 pages.
English translation; Sundanese Application No. SU1344256A3; published Oct. 7, 1987; 5 pages.
English translation; Chinese Application No. CN101092874 published Jul 6, 2011; 21 pages.
Chinese Search Report of corresponding China Application; Application No. CN201180058212X; Application Filing Date: Nov. 18, 2011; 1 page.

* cited by examiner

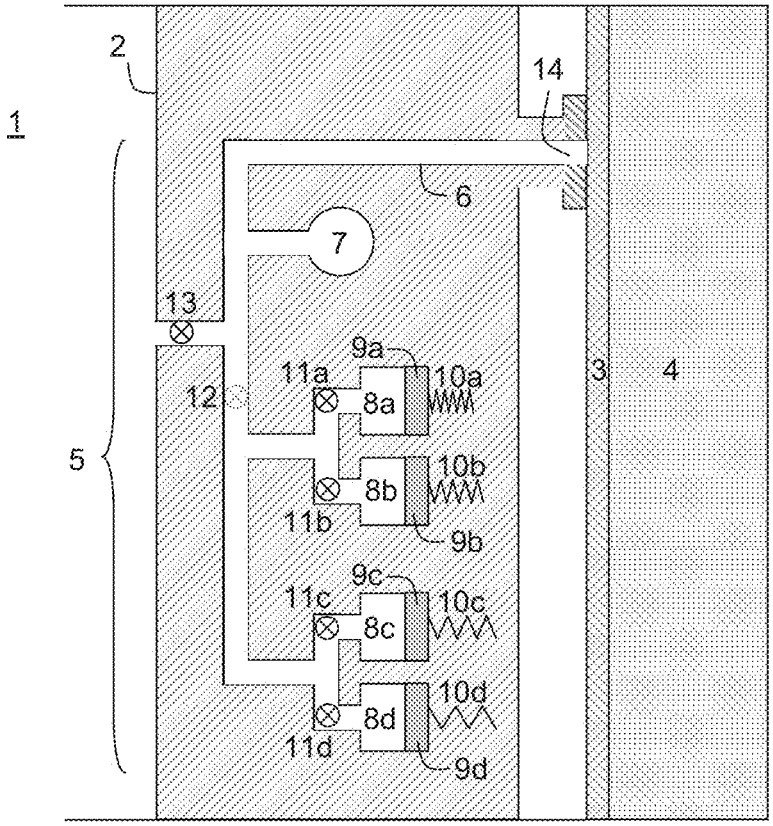
1
2
14
6
7
13
12
5
9a
11a
8a
10a
3
4
8b
10b
11b
9b
9c
11c
8c
10c
8d
10d
11d
9d

METHOD FOR MEASURING PRESSURE IN AN UNDERGROUND FORMATION

FIELD OF THE INVENTION

The present invention relates to a method for measuring pressure in an underground formation as well as a device adapted to the implementation thereof.

BACKGROUND OF THE INVENTION

An in-depth exploration of any underground formation containing hydrocarbons is a necessary prerequisite to the extraction of hydrocarbons from the formation.

In order to proceed with that in-depth exploration, it is known to drill an exploration well and insert a series of instruments into said exploration well making it possible to perform in situ measurements: pressure measurement, temperature measurement, sample withdrawal, etc. It is also known to incorporate the set of measuring instruments into a downhole well tool assembled on a cable ("wireline formation tester") and adapted to be lowered into the well to determine the profiles of various parameters along the well.

In particular, the pressure measurements are used to determine the mobility of the fluids contained in the underground formation and the permeability of the underground formation. In general, the pressure is measured by locally imposing a vacuum through fluid suction in a test chamber provided with a piston until the filter cake of the well is broken, then allowing the system to return to equilibrium and measuring the evolution of the pressure during the return to equilibrium.

It is in this way that the company Schlumberger developed several generations of downhole well tools making it possible in particular to perform pressure measurements. First, the RFT (repeat formation tester) tool comprises two test chambers, the first operating at a fixed rate Q1 and the second operating at a fixed rate Q2 that is twice the rate Q1. A unique measuring sequence is carried out by suctioning the fluid successively in both chambers. This device does not make it possible to perform several successive measurement sequences (pre-tests) at a same position along the well. Furthermore, the suctioned fluid flow rate is not adjustable, but the necessary rate varies greatly depending on the characteristics of the underground formation.

Moreover, the MDT (modular formation dynamics tester tool) is equipped with a single test chamber provided with a hydraulic control motor. Lastly, the XPT tool (express pressure tool) comprises a test chamber provided with an electric control motor with a worm screw. These tools allow monitoring of the flow rate during the pre-tests, but the precision of the flow rate or the extent of the achievable flow rate range remain unsatisfactory.

Furthermore, one problem related to these tools is that when several pre-tests are linked to a same position along the well, the evolution of the pressure during the return toward equilibrium necessarily differs from one pre-test to the next, due to the variation of the fluid volume in the instrument. The duration of the transitional state increases during successive pre-tests. Thus, it is necessary to acquire the pressure over a very long time period in order to be able to perform statistical processing of the results, as well as to verify whether the measurements are consistent with one another or if the measurements may be inconsistent and therefore not significant, which is the case of low-permeability underground formations. In fact, in low-permeability underground formations, overload phenomena occur, i.e. the mud in the well tends to penetrate the underground formation due to the small difference between the permeability of the filter cake and the permeability of the formation (the filter cake being correlatively not very sealed relative to the underground formation).

In other words, the tools of the state of the art do not make it possible to quickly identify situations in which the permeability of the underground formation is too low to allow a significant pressure measurements; and they do not make it possible to quickly carry out repeated pre-tests in order to obtain truly representative pressure data.

There is therefore a major need to develop a method and a device making it possible to perform pressure measurements in an underground formation more quickly, simply and reliably than with the methods and devices of the state of the art.

BRIEF DESCRIPTION OF THE INVENTION

The invention first relates to a method for measuring pressure in an underground formation containing a fluid, comprising the following consecutive steps:

- establishing fluid communication between a test chamber arranged in a drilling well and the underground formation, via a flowline;
- moving a piston in the test chamber so as to suction fluid into the test chamber;
- ensuring fluid isolation of the test chamber relative to the flowline;
- measuring the pressure in the flowline; and
- repeating the preceding steps.

According to one embodiment, the fluid isolation of the test chamber is done by closing at least one valve between the flowline and the test chamber, and establishing the fluid communication between the test chamber and the underground formation by opening said valve.

According to one embodiment, the method is implemented using a downhole well tool arranged in the drilling well.

According to one embodiment, the downhole well tool includes a plurality of test chambers, the method including a preliminary step for choosing a test chamber.

According to one embodiment, each test chamber is associated with a particular flow rate range, the method including the preliminary steps of:

- choosing an appropriate flow rate;
- choosing a test chamber whereof the flow rate range comprises the appropriate flow rate;
- and the fluid is suctioned in the test chamber at the selected fluid rate.

According to one embodiment, the choice of the flow rate is made in a flow rate range comprised between a minimum flow rate and a maximum flow rate, the ratio of the maximum flow rate to the minimum flow rate being greater than or equal to 10, preferably greater than or equal to 100, preferably greater than or equal to 1,000, preferably greater than or equal to $10^4$, preferably greater than or equal to $10^5$, and preferably greater than or equal to $10^6$.

The invention also relates to a method for determining the permeability of the underground formation or determining the mobility of the fluid of the underground formation, comprising a pressure measurement according to the above-mentioned method, and calculating the permeability of the underground formation or the mobility of the fluid of the underground formation from the result of the pressure measurement.

The invention also relates to a device for measuring pressure in an underground formation containing a fluid, comprising:

at least one test chamber provided with a piston;

a flowline in fluid communication with the test chamber;

a pressure sensor in the flowline;

a probe adapted to establish a fluid communication between the underground formation and the flowline;

at least one closing system adapted to fluidly isolate the test chamber from the flowline.

According to one embodiment, the device comprises a plurality of test chambers, preferably at least two, or at least three, or at least four, or at least five, or at least six test chambers.

According to one embodiment, the closing system includes a single valve adapted to fluidly isolate the set of test chambers from the flowline.

According to one embodiment, the closing system includes a plurality of valves, each valve being adapted to fluidly isolate one of the test chambers from the flowline.

According to one embodiment, at least part of the test chambers have different volumes.

According to one embodiment, the pistons of the test chambers are respectively controlled by an electric motor connected to a worm screw whereof the screw pitch differs from one test chamber to the next.

The invention also relates to a downhole well tool adapted to perform measurements in an underground formation containing a fluid, the downhole well tool including a cable adapted to be inserted into a drilling well and a measuring device as described above incorporated into the cable.

The present invention makes it possible to overcome the drawbacks of the state of the art. It more particularly provides a method and a device making it possible to perform pressure measurements in an underground formation more quickly, simply and reliably than with the methods and devices of the state of the art.

This is accomplished owing to the introduction of a closing system including at least one valve, which makes it possible to fluidly isolate the test chamber upon each pre-test, as soon as the piston is stopped. Thus, one ensures that the volume available for the fluid during the return to equilibrium (during which the pressure measurement is done) remains constant from one pre-test to the next. Thus, the results of the different pre-tests can be directly compared without having to wait for the end of the transitional state, so as to determine whether those results are coherent and therefore exploitable, or if the pressure measurement is not significant due to an excessively low permeability of the underground formation.

According to one particular embodiment, the invention provides for using a plurality of test chambers each operating at an adjustable flow rate in a given flow rate range (and distinct from one chamber to the next). In this way, it is possible to ensure the success of the pressure measurement for quite variable permeabilities of the underground formation.

In fact, if the flow rate is too high in light of a relatively low permeability of the underground formation, the vacuum caused cannot be resorbed in a reasonable period and it is impossible to perform a significant measurement. Conversely, an excessively low flow rate does not make it possible to obtain a sufficient signal/noise ratio. It is therefore extremely useful to be able to adapt the flow rate in the largest possible range, so as to adapt to the most varied situations (given that the permeability of the underground formation and/or the mobility of the fluid it contains can be quite variable).

BRIEF DESCRIPTION OF THE FIGURES

FIG. 1 diagrammatically shows a device according to the invention.

DETAILED DESCRIPTION OF THE INVENTION

The invention will now be described in more detail and non-limitingly in the following description.

In reference to FIG. 1, the invention is implemented in a drilling well 1 that is drilled in an underground formation 4 containing a fluid. The term "fluid" designates gas and/or liquid, the liquid generally comprising water and/or oils.

A drilling well is generally filled with a drilling fluid such as water or an oil-based fluid. The density of the drilling fluid is generally increased by adding solids, such as salts and other additives, to form a drilling mud. The drilling mud makes it possible to obtain a hydrostatic pressure in the well adapted to avoid the cave-in of the well and prevent the fluid of the underground formation from escaping into the well.

The solids contained in the drilling mud create a layer on the inner wall of the well, called filter cake 3. The filter cake 3 isolates the underground formation 4 from the inside of the well 1.

A downhole well tool 2 is an apparatus comprising a cable adapted to be inserted into the well and generally provided with a plurality of measuring devices such as devices for taking samples, measuring temperature, measuring boiling point, etc. The downhole well tool 2 according to the invention includes at least one pressure measuring device 5 incorporated into the cable.

The pressure measuring device 5 includes a probe 14 that is adapted to put the underground formation 4 and a flowline 6 of the device in fluid communication. Typically, the probe 14 comprises an inlet opening provided with a filter and surrounded by pads, and is adapted to come into contact with the filter cake 3 while isolating a portion of the filter cake 3 from the inside of the well 1. According to another embodiment (not shown), the probe 14 can comprise a set of upper and lower tires adapted to isolate a section of the well 1 from the rest of the well, as well as an intake opening in the isolated section provided with a filter, away from the filter cake 3.

The pressure measuring device 5 also includes a balancing valve 13, which is adapted to put the flowline 6 at the hydraulic pressure of the well 1. This balancing valve 13 is open at the beginning of the measuring method, then closed to fluidly isolate the flowline 6 from the inside of the well 1 during all of the pre-tests.

A pressure sensor 7 makes it possible to measure the pressure in the flowline 6.

The pressure measuring device 5 also includes one or more test chambers 8*a*, 8*b*, 8*c*, 8*d*. Preferably, several test chambers 8*a*, 8*b*, 8*c*, 8*d* are provided, for example 2 or 3 or 4 or 5 or 6. Each test chamber 8*a*, 8*b*, 8*c*, 8*d* is provided with a respective piston 9*a*, 9*b*, 9*c*, 9*d* adapted to move in the test chamber 8*a*, 8*b*, 8*c*, 8*d* so as to cause a flow of fluid.

Preferably, the pistons 9*a*, 9*b*, 9*c*, 9*d* are actuated by respective electric motors connected to worm screws 10*a*, 10*b*, 10*c*, 10*d*, which makes it possible to monitor the rate of the fluid flow caused by each test chamber 8*a*, 8*b*, 8*c*, 8*d*. It is advantageous to provide worm screws 10*a*, 10*b*, 10*c*, 10*d* with different screw pitches depending on the test chambers 8*a*, 8*b*, 8*c*, 8*d*. In this way, the accessible range of rates differs from one test chamber 8*a*, 8*b*, 8*c*, 8*d* to the next. Thus, it is possible to have a very broad total flow rate range, each rate in the range being able to be reached by one or more given test chambers 8*a*, 8*b*, 8*c*, 8*d*. As an example, it is possible to use a first test chamber adapted to operate in a flow rate range Q1-Q2 with Q2=10×Q1, a first test chamber adapted to operate in a flow rate range Q2-Q3 with Q3=10×Q2, a third test chamber adapted to operate in a flow rate range Q3-Q4 with Q4=10×Q3 and so on.

The test chambers 8*a*, 8*b*, 8*c*, 8*d* can have different volumes in order to take the diversity of the corresponding flow rates into account.

The invention also provides a closing system adapted to put the flowline 6 in fluid communication with the test chamber(s) 8*a*, 8*b*, 8*c*, 8*d* or on the contrary to isolate the flowline 6 from the test chamber(s) 8*a*, 8*b*, 8*c*, 8*d*.

For example, a respective valve 11 a, 11 b, 11 c, 11 d can be used associated with each test chamber 8*a*, 8*b*, 8*c*, 8*d*. Alternatively, it is possible to provide a single valve 12 between the flowline 6 and the set of test chambers 8*a*, 8*b*, 8*c*, 8*d*.

The implementation of the inventive method assumes performing several pre-tests at a same location of the well 1 (i.e. for the same anchoring of the probe 14).

During each pre-test, fluid is suctioned in one of the test chambers 8*a*, 8*b*, 8*c*, 8*d* at the chosen flow rate by moving the concerned piston 9*a*, 9*b*, 9*c*, 9*d* at a monitored speed. Thus, a vacuum appears in the flowline 6 and the fluid coming from the underground formation 4 is inserted into the flowline 6 (after local rupture of the filter cake 3). Then, the piston 9*a*, 9*b*, 9*c*, 9*d* is stopped. The concerned valve 11*a*, 11*b*, 11*c*, 11*d*, 12 is closed at essentially the same time as the stop of the piston 9*a*, 9*b*, 9*c*, 9*d* (preferably either at exactly the same time, or slightly before). The pressure in the flowline 6 is acquired for a certain time, then one moves on to the next pre-test.

The concerned valve 11*a*, 11*b*, 11*c*, 11*d*, 12 is then reopened, and fluid is again suctioned in the test chamber 8*a*, 8*b*, 8*c*, 8*d* as described above. The valve 11*a*, 11*b*, 11*c*, 11*d*, 12 is closed again to measure the pressure once the movement of the piston 9*a*, 9*b*, 9*c*, 9*d* is interrupted. The fluid sampling time is generally constant from one pre-test to the next, and can for example be in the vicinity of 5 to 10 seconds.

Thus, the pressure measurement by the pressure sensor 7 is always done at a constant volume and constant pressure loss for all of the pre-tests. The data obtained from one pre-test to the next is therefore directly comparable. It is possible to establish an average or any other statistical processing of the data from the set of pre-tests.

The pressure measurement makes it possible to evaluate the permeability of the underground formation or the mobility of the fluid in the underground formation, using methods known in the field, and which are for example described in document U.S. Pat. No. 7,263,880.

Once all of the desired pre-tests have been carried out, the probe 14 is unanchored, the position of the downhole well tool 2 is changed in the well 1, and a new series of pre-tests can be started again in a new position.

The invention claimed is:

1. A method for measuring pressure in an underground formation containing a fluid, comprising:

establishing fluid communication between a first test chamber arranged in a drilling well and the underground formation, via a flowline;

moving a piston in the first test chamber so as to suction fluid into the first test chamber;

ensuring fluid isolation of the first test chamber relative to the flowline;

maintaining fluid isolation of the first test chamber;

measuring the pressure in the flowline at a point in the flowline isolated from the first test chamber during the maintaining of the fluid isolation of the first test chamber; and repeating the preceding steps with the first test chamber or another test chamber.

2. The method according to claim 1, wherein the fluid isolation of the test chamber is done by closing at least one valve between the flowline and the test chamber, and establishing the fluid communication between the test chamber and the underground formation by opening said valve.

3. A method for determining the permeability of the underground formation or determining the mobility of the fluid of the underground formation, comprising a pressure measurement according to the method of claim 1, and calculating the permeability of the underground formation or the mobility of the fluid of the underground formation from the result of the pressure measurement.

4. The method according to claim 1, which is implemented using a downhole well tool arranged in the drilling well.

5. The method according to claim 4, wherein the downhole well tool includes a plurality of test chambers, the method including a preliminary step for choosing a test chamber.

6. The method according to claim 5, wherein each test chamber is associated with a particular flow rate range, the method including the preliminary steps of:

choosing an appropriate flow rate;

choosing a test chamber whereof the flow rate range comprises the appropriate flow rate;

and wherein the fluid is suctioned in the test chamber at the selected fluid rate.

7. The method according to claim 6, wherein the choice of the flow rate is made in a flow rate range comprised between a minimum flow rate and a maximum flow rate, the ratio of the maximum flow rate to the minimum flow rate being greater than or equal to 10.

8. A device for measuring pressure in an underground formation containing a fluid, comprising:

at least one test chamber provided with a piston;

a flowline in fluid communication with the at least one test chamber;

a pressure sensor in the flowline;

a probe adapted to establish a fluid communication between the underground formation and the flowline;

the piston configured to move in the at least one test chamber so as to suction fluid into the at least one test chamber; and at least one closing system configured to repeatedly establish fluid communication between the at least one test chamber arranged in a drilling well and the underground formation, via the flowline;

ensure fluid isolation of the at least one test chamber relative to the flowline;

maintain fluid isolation of the at least one test chamber;

the pressure sensor being located in the flowline at a point in the flowline isolated from the at least one test chamber during the maintaining of the fluid isolation of the at least one test chamber.

9. The device according to claim 8, further comprising a plurality of test chambers, wherein each test chamber of the plurality of test chambers comprises a piston.

10. The device according to claim 9, wherein the at least one closing system includes a single valve adapted to fluidly isolate the plurality of test chambers from the flowline.

11. The device according to claim 9, wherein the at least one closing system includes a plurality of valves, each valve being adapted to fluidly isolate one of the plurality of test chambers from the flowline.

12. The device according to claim 9, wherein at least two of the plurality of test chambers have different volumes.

13. The device according to claim 9, wherein each piston for each test chamber is respectively controlled by an electric motor connected to a worm screw having a screw pitch, wherein the screw pitch differs from one test chamber to the next.

14. A downhole well tool adapted to perform measurements in an underground formation containing a fluid, the downhole well tool including a cable adapted to be inserted into a drilling well and a measuring device for measuring pressure in the underground formation, the measuring device provided with the cable and comprising:

at least one test chamber provided with a piston;

a flowline in fluid communication with the at least one test chamber;

a pressure sensor in the flowline;

a probe adapted to establish a fluid communication between the underground formation and the flowline;

at least one closing system adapted to repeatedly fluidly isolate the at least one test chamber from the flowline; wherein the pressure sensor is configured to measure pressure in the flowline:

after each isolation of the at least one test chamber from the flowline;

while maintaining fluid isolation of the at least one test chamber relative to the flowline; and at a point in the flowline isolated from the at least one test chamber.

15. The downhole well tool according to claim 14, wherein the measuring device comprises a plurality of test chambers, and each test chamber of the plurality of test chambers comprises a piston.

16. The downhole well tool according to claim 15, wherein the at least one closing system includes a single valve adapted to fluidly isolate the plurality of test chambers from the flowline.

17. The downhole well tool according to claim 15, wherein the at least one closing system includes a plurality of valves, each valve being adapted to fluidly isolate one of the plurality of test chambers from the flowline.

18. The downhole well tool according to claim 15, wherein at least two of the plurality of test chambers have different volumes.

19. The downhole well tool according to claim 15, wherein each piston for each test chamber is respectively controlled by an electric motor connected to a worm screw having a screw pitch, wherein the screw pitch differs from one test chamber to the next.

20. A method for measuring pressure in an underground formation containing a fluid, the method employing the device of claim 8 or 14, the method comprising the following consecutive steps:

establishing fluid communication between at least one test chamber arranged in a drilling well and the underground formation, via a flowline;

moving the piston in the at least one test chamber to suction fluid into the at least one test chamber;

ensuring fluid isolation of the at least one test chamber relative to the flowline;

measuring the pressure in the flowline while maintaining fluid isolation of the at least one test chamber relative to the flowline, wherein the measuring occurs at a point in the flowline isolated from the at least one test chamber; and repeating the preceding steps.

* * * * *